US009144367B2

(12) United States Patent
Mehdizadeh

(10) Patent No.: US 9,144,367 B2
(45) Date of Patent: Sep. 29, 2015

(54) LAMINATE CLEANING SHEET

(71) Applicant: Shahrad Rody Mehdizadeh, Great Neck, NY (US)

(72) Inventor: Shahrad Rody Mehdizadeh, Great Neck, NY (US)

(73) Assignee: U.S. Nonwovens Corp., Brentwood, NY (US)

( * ) Notice: Subject to any disclaimer, the term of this patent is extended or adjusted under 35 U.S.C. 154(b) by 489 days.

(21) Appl. No.: 13/683,034

(22) Filed: Nov. 21, 2012

(65) Prior Publication Data

US 2014/0137889 A1 May 22, 2014

(51) Int. Cl.

| | |
|---|---|
| ***B08B 3/00*** | (2006.01) |
| ***A47L 25/00*** | (2006.01) |
| ***A47L 13/16*** | (2006.01) |

(52) U.S. Cl.

CPC ..... *A47L 25/005* (2013.01); *A47L 13/16* (2013.01)

(58) Field of Classification Search

None

See application file for complete search history.

(56) References Cited

U.S. PATENT DOCUMENTS

| | | | |
|---|---|---|---|
| 3,376,595 | A | 4/1968 | Cole |
| 3,412,418 | A | 11/1968 | Griffin |
| 3,629,047 | A | 12/1971 | Davison |
| 3,742,547 | A | 7/1973 | Sohmer |
| 3,991,432 | A | 11/1976 | Griffin et al. |
| 4,114,223 | A | 9/1978 | Buchanan |
| 4,523,347 | A | 6/1985 | Tames |
| 5,115,535 | A | 5/1992 | Casademunt Ferre et al. |
| 5,144,729 | A | 9/1992 | Austin et al. |
| 5,280,664 | A | 1/1994 | Lin |
| 6,101,661 | A | 8/2000 | Policicchio et al. |
| 6,305,046 | B1 | 10/2001 | Kingry et al. |
| 6,601,261 | B1 | 8/2003 | Holt et al. |
| 6,716,805 | B1 | 4/2004 | Sherry et al. |
| 6,766,552 | B1 | 7/2004 | Policicchio et al. |
| 6,810,554 | B2 | 11/2004 | McKay |
| 7,350,257 | B2 | 4/2008 | McKay |
| 7,694,379 | B2 | 4/2010 | Glaug |
| 8,250,700 | B2 | 8/2012 | Pung et al. |
| 2006/0128240 | A1 | 6/2006 | Policicchio et al. |

*Primary Examiner* — Eric Golightly

(74) *Attorney, Agent, or Firm* — Hasse & Nesbitt; Donald E. Hasse

(57) ABSTRACT

A cleaning sheet for attachment to a mop for cleaning a floor. The cleaning sheet is a laminate comprising a lower layer of fibrous material for contacting the floor, an intermediate layer attached to the lower layer and having a top surface comprising release material, and an upper layer releasably attached to the intermediate layer. The upper layer has a bottom surface comprising adhesive material on at least a central portion thereof. After the lower layer is used to clean a floor, the lower and intermediate layers are removed from the upper layer to expose the adhesive material. The upper layer can then be used to pick up remaining dirt and particulate material. Also disclosed is a method of cleaning a floor using the above sheet.

19 Claims, 3 Drawing Sheets

Prior Art

LAMINATE CLEANING SHEET

FIELD OF THE INVENTION

This invention relates to cleaning sheets for use with a mop that are particularly suitable for removal and entrapment of dust, lint, hair, dirt, sand, food crumbs, and other particulate material from a floor. More particularly, the invention relates to a laminate sheet comprising a lower fibrous layer, an intermediate release layer, and an upper layer comprising adhesive material. After the lower layer is used to clean a floor, the lower and intermediate layers can be removed from the upper layer to expose the adhesive material and the upper layer can be used to pick up remaining dirt and particulate material.

BACKGROUND OF THE INVENTION

Nonwoven sheets used for dry dust-type cleaning typically utilize a composite of fibers that can be thermally or adhesively bonded or bonded by entanglement or other forces, such as described in U.S. Pat. Nos. 3,629,047 and 5,144,729. When the cleaning sheet is used with a mop, the sheet is typically mechanically attached to the mop head via grippers located on the top of the mop head. A portion of the cleaning sheet contacts the floor being cleaned in order to collect and trap soils such as dust, lint, dirt, crumbs and other particles. To improve cleaning efficacy, the sheet is often made out of a synthetic non-woven material that develops an electrostatic charge capable of "attracting" particles during the mopping operation. Other cleaning sheets include an additive, such as waxes, oils, or polymeric additives, to enhance the pick-up and retention of soils by the cleaning sheet. For example, polymeric additives that are tacky or sticky can be used to enhance large particle pick-up. However, particulate material often remains on the floor after the mopping operation. The consumer may then need to use a dust bin or wet paper towel to pick up the remaining particles. Moreover, polymeric additives on cleaning sheets may leave a residue on the surface of the floor.

Accordingly, there is a continuing need for an improved cleaning sheet and method to increase the efficacy of the cleaning sheet, particularly regarding particle pick-up, without leaving an unacceptable amount of residue on the floor being cleaned.

SUMMARY OF THE INVENTION

The present invention relates to a cleaning sheet for attachment to a mop for cleaning a floor, said sheet being a laminate comprising: a) a lower layer of fibrous material for contacting the floor, said lower layer having a bottom surface and a top surface, b) an intermediate layer having a bottom surface attached to the top surface of the lower layer, and a top surface comprising release material, and c) an upper layer releasably attached to the intermediate layer, said upper layer having a bottom surface comprising adhesive material on at least a central portion thereof and a top surface attachable to a bottom surface of a mop, wherein after the lower layer is used to clean a floor, the lower and intermediate layers can be removed from the upper layer to expose the adhesive material on the bottom surface of the upper layer and the upper layer can be used to pick up remaining dirt and particulate material from the floor.

The invention also relates to a cleaning sheet for attachment to a mop for cleaning a floor, said sheet being a laminate comprising: a) a lower layer of a fibrous nonwoven web of hydrophobic polymer for contacting the floor, said lower layer having a bottom surface and a top surface, b) an intermediate layer having a bottom paper or plastic substrate attached to the top surface of the lower layer, and a top surface coated with a release material, and c) an upper layer releasably attached to the intermediate layer, said upper layer having a bottom surface comprising adhesive material on at least a central portion thereof and a top surface attachable to a bottom surface of a mop, wherein after the lower layer is used to clean a floor, the lower and intermediate layers can be removed from the upper layer to expose the adhesive material on the bottom surface of the upper layer so it can be used to pick up remaining dirt and particulate material from the floor.

The invention also relates to a method of cleaning a floor comprising: (1) providing a cleaning sheet being a laminate comprising a) a lower layer of a fibrous nonwoven web of hydrophobic polymer for contacting the floor, said lower layer having a bottom surface and a top surface, b) an intermediate layer having a bottom paper or plastic substrate attached to the top surface of the lower layer, and a top surface coated with a release material, and c) an upper layer releasably attached to the intermediate layer, said upper layer having a bottom surface comprising adhesive material on at least a central portion thereof and a top surface attachable to a bottom surface of a mop; (2) attaching the cleaning sheet to a mop; (3) cleaning a floor using the mop and attached cleaning sheet; (4) removing the lower and intermediate layers of the cleaning sheet from the upper layer to expose the adhesive material on the bottom surface of the upper layer; and (5) picking up remaining dirt and particles from the floor by applying the upper layer containing the adhesive against portions of the floor containing the dirt and particles.

DETAILED DESCRIPTION OF THE INVENTION

The present invention relates to cleaning sheets for use with a mop that are particularly suitable for removal and entrapment of dust, lint, hair, dirt, sand, food crumbs, and other particulate material from a floor. More particularly, the invention relates to a cleaning sheet in the form of a laminate comprising a lower fibrous layer for contacting the floor, an intermediate layer attached to the lower layer and having a top surface comprising release material, and an upper layer releasably attached to the intermediate layer and having a bottom surface comprising adhesive material. After the lower layer is used to clean a floor, the lower and intermediate layers can be removed from the upper layer to expose the adhesive material on the bottom surface thereof. The upper layer can then be used to pick up remaining dirt and particulate material from the floor.

As used herein, the term "hydroentanglement" means generally a process for making a material wherein a layer of loose fibrous material (e.g., polyester) is supported on an apertured patterning member and is subjected to water pressure differentials sufficiently great to cause the individual fibers to entangle mechanically to provide a fabric. The apertured patterning member can be formed, e.g., from a woven screen, a perforated metal plate, etc.

As used herein, the term "layer" refers to a component of a cleaning sheet whose primary dimension is X-Y, i.e., along its length and width. It should be understood that the term layer is not necessarily limited to a single layer or sheet of material. Thus, a layer can comprise laminates or combinations of several sheets, webs or layers of the requisite type of materials. Accordingly, the term "layer" includes the terms "layers" and "layered." Moreover, a layer may comprise other materials, including additives such as the release material or the adhesive material described herein.

For purposes of the present invention, an "upper" layer of a cleaning sheet is a layer that is relatively further away from the surface to be cleaned. The term "lower" layer means a layer of a cleaning sheet that is relatively closer to the surface to be cleaned. The "top surface" of a layer or cleaning sheet is the surface that is relatively further away from the surface to be cleaned. The "bottom surface" means the surface of the layer or cleaning sheet that is relatively closer to the surface that is to be cleaned.

Figure 1:
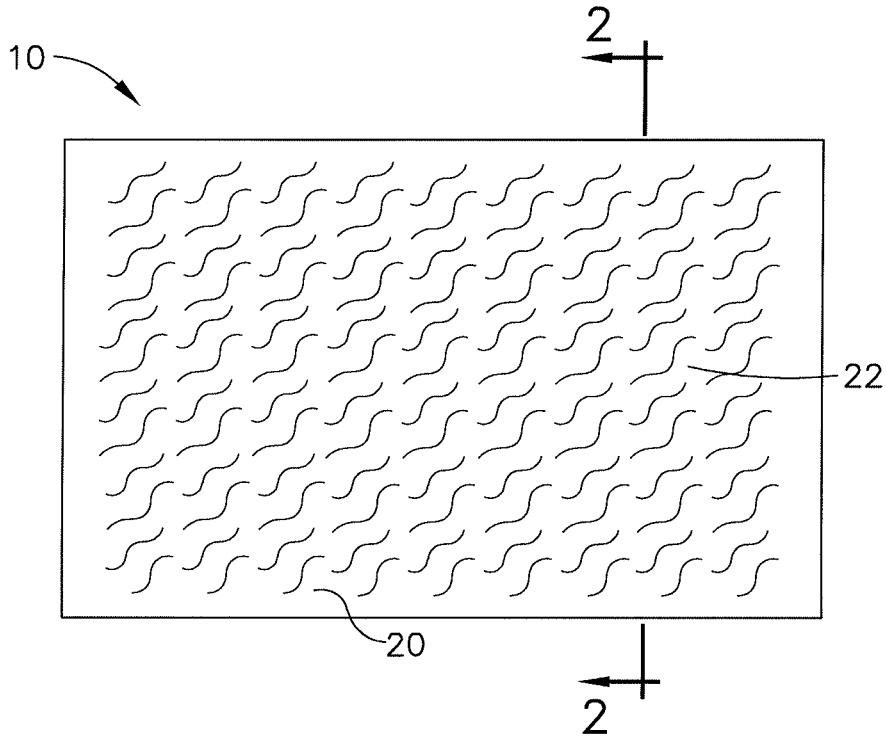
FIG. 1 is bottom view of a cleaning sheet of the invention.
Figure 2:
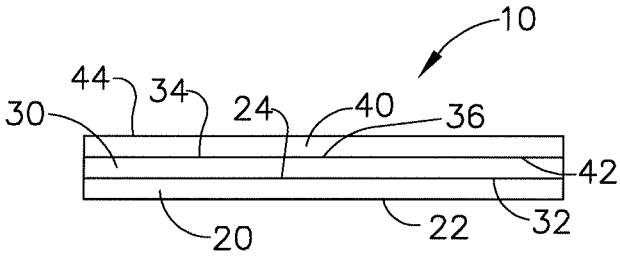
FIG. 2 is a section view of the cleaning sheet of FIG. 1 taken along line 2-2.

Referring to FIGS. 1 and 2, the cleaning sheet 10 is a laminate comprising a lower layer 20 of fibrous material for contacting the floor. The lower layer has a bottom surface 22 and a top surface 24. The lower layer 20 can be made using either a woven or nonwoven substrate via several processes. Non-limiting example of processes suitable to make the lower layer include forming operations using melted materials laid down on forms, especially in belts, forming operations involving mechanical actions/modifications carried out on films, imaging/patterning process involving an imaging device having a drum with an imaging surface and/or by embossing operations, and combinations thereof. The substrate used for the lower layer can be made by any number of methods (e.g., hydroentangled, spunbonded, meltblown, carded resin bonded, carded through air-bonded, carded thermal bonded, air laid, etc.), once the dimensions and basis weight requirements are determined. The substrate typically is nonwoven, especially formed by hydroentanglement, since it provides desirable open fibrous structure. Materials suitable for forming a nonwoven lower layer include, for example, natural cellulosics, and particularly synthetics such as polyolefins (e.g., polyethylene and polypropylene), polyesters, polyamides, synthetic cellulosics (e.g., RAYON™), and blends thereof. Also useful are natural fibers, such as cotton or blends thereof and those derived from various cellulosic sources. Materials for making hydroentangled fibrous sheets are typically synthetic materials, which may be in the form of carded, spunbonded, meltblown, airlaid, or other structures, particularly polyesters, especially carded polyester fibers. The degree of hydrophobicity or hydrophilicity of the fibers can be optimized depending upon the desired goal of the lower layer, either in terms of type of soil to be removed, biodegradability, availability, and combinations of such considerations. In general, the more biodegradable materials are hydrophilic, but the more effective materials tend to be hydrophobic.

The lower layer 20 may be formed from a single fibrous layer, but typically is a composite of at least two separate layers. In one embodiment, the lower layer is a nonwoven made via a hydroentangling process. Prior to hydroentangling discrete layers of fibers, it may be desired to slightly entangle each of the layers prior to joining the layers by entanglement. The lower layer may be textured to optimize the cleaning surface available on the sheet, and may have a macroscopic three-dimensional pattern. The lower layer typically has a basis weight of at least about 40 g/m$^2$, typically between about 50 g/m$^2$ and 90 g/m$^2$, and more typically between about 55 g/m$^2$ and about 80 g/m$^2$.

If desired, the lower layer 20 may comprise an additive, such as a wax, on its bottom surface 22 for increasing the cleaning efficacy of the cleaning sheet. Waxes can be classified into several categories including insect/animal waxes, such as beeswax (from honey comb structures) or spermaceti from sperm whale; vegetable waxes such as carnauba, candelilla, or Japan wax; mineral waxes such as montan, ozokerite, or ceresine; petroleum based waxes such as paraffin (or macro-crystalline) and micro-crystalline waxes; and synthetic waxes such as polyethylene. Such an additive may increases the cleaning efficacy of a sheet by enhancing pick-up and retention of particulates. The additive applied on the lower layer 20 of the sheet may be used at a level such that it enhances the tack properties, but does not substantially produce residue and/or does not significantly reduce the ability of the sheet to be electrostatically charged.

Referring to FIG. 2, the laminate cleaning sheet 10 comprises an intermediate layer 30 having a bottom surface 32 attached to the top surface 24 of the lower layer, for example by glue or other adhesive material, or by thermal or mechanical bonding. For example, glue or other adhesive material can be applied to the bottom surface of the intermediate layer, or the top surface of the lower layer, prior to joining the intermediate and lower layers. The top surface 34 of the intermediate layer 30 comprises a release material 36 on at least a central portion thereof, but typically over a major portion thereof, including up to the entire top surface 34. The intermediate layer 30 may be a release layer that may comprise a paper or plastic carrier or substrate coated with a release material 36 on at least a central portion of its top surface 34.

The paper or plastic carrier or substrate can be made of a wide variety of materials known in the art. Examples include SCK (Super Calendared Kraft paper), Glassine (an SCK paper typically with a PVOH top coat), CCK (Clay Coated Kraft paper), MFK (Machine Finished Kraft paper), MG (Machine Glazed paper), and various types of wax paper. Plastic films include those made of various BO-PET, BOPP, HDPE, LDPE and PP resins. Plastic films can be made by various resins extrusion processes, and may comprise a single plastic material, a blend of different materials, or multilayered coextrusions. Suitable release materials include cross-linkable silicones and other materials known in the art that have low surface energy.

Figure 3:
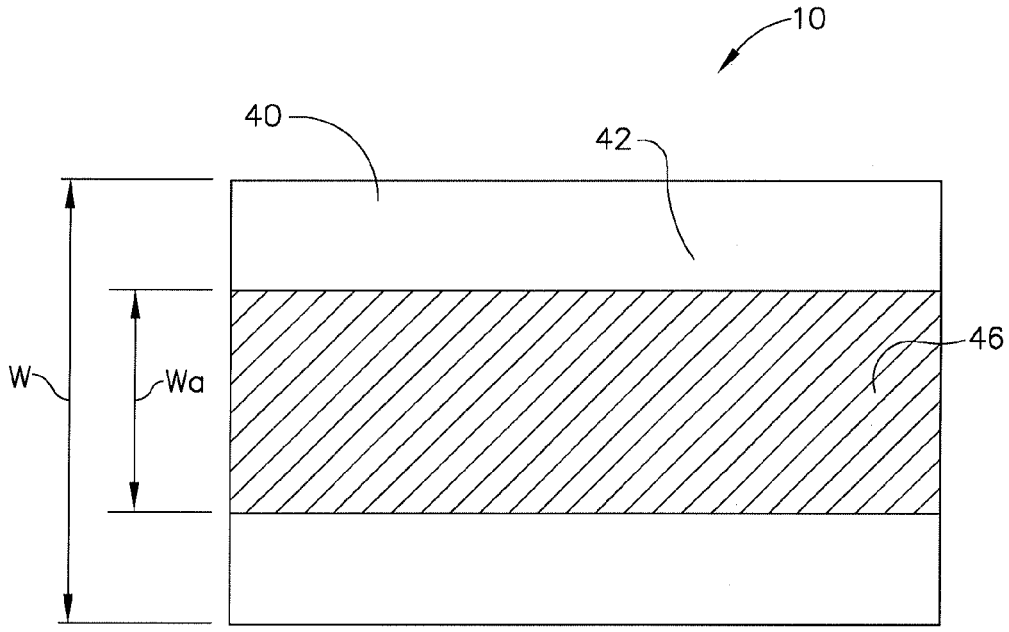
FIG. 3 is a bottom view of a portion of the cleaning sheet after the lower and intermediate layers have been removed from the upper layer to expose adhesive material on the bottom surface of the upper layer.

Referring now to FIGS. 2 and 3, the laminate cleaning sheet 10 further comprises an upper layer 40 releasably attached to the intermediate layer 30, and thus also to the lower layer 20 to which the intermediate layer is attached. The upper layer 40 may comprise any suitable cloth, paper or plastic substrate material. In one embodiment, the upper layer may comprise two or more layers, for example, a paper sticker layer adhered to an upper layer. The upper layer typically is made of a fibrous material such as in lower layer 20, including a nonwoven material as described above. The upper layer has a bottom surface 42 comprising adhesive material 46 on at least a central portion thereof. Any suitable adhesive material may be used. All or at least substantially all of the adhesive material typically is covered by the release material 36 on the top surface 34 of the intermediate layer so that the adhesive material does not prevent removal of the upper layer from the lower and intermediate layers. In one embodiment, the upper layer can be an adhesive nonwoven where 100% of the entire surface has adhesive built into the structure. In another embodiment, the adhesive material is located on a middle portion of the upper layer. In FIG. 3, the portion coated with adhesive material 46 has a width Wa between about 30% and about 90%, typically between about 40% and about 80%, more typically between about 50% and about 70%, of the total width W of the upper layer 40 of the cleaning sheet 10. The adhesive material is typically applied across at least about 50%, more typically at least about 75%, of the length of the cleaning sheet. In FIG. 3, the adhesive material is applied across the entire length of the cleaning sheet. In one embodiment, the remaining portions of the bottom surface 42 of the upper layer which are adjacent the front and back leading edges of the sheet, are substantially free from adhesive material. The ends of these portions of the sheet are typically tucked around the mop head and inserted into attachment structures on the top of the mop head to mechanically attach the sheet to the mop head.

Figure 4:
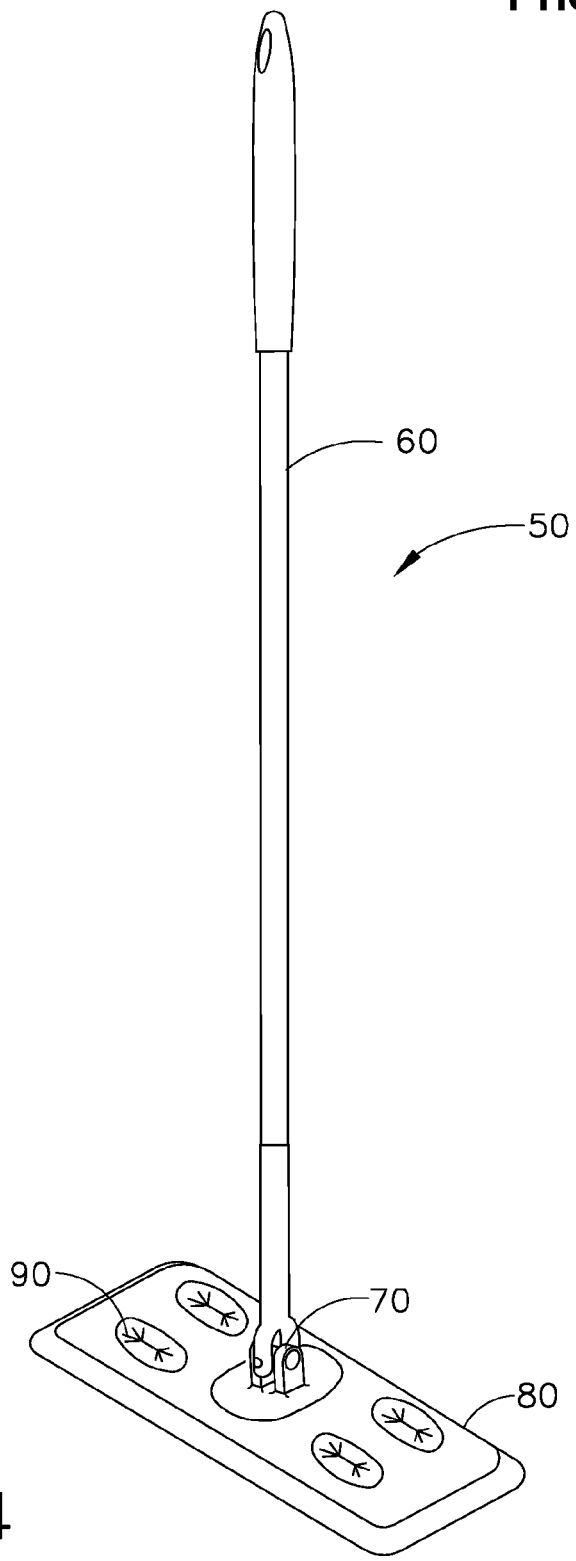
FIG. 4 is a perspective view of a cleaning mop to which the cleaning sheet of the invention can be attached.

The cleaning sheets as described above can be used with a cleaning mop comprising a handle and a mop head. FIG. 4 shows a cleaning mop 50 having a handle 60 and a mop head 80 rotatably connected to the handle via joint 70. The mop head 80 can have any shape or size and includes attachment structures or grippers for retaining a cleaning sheet about the mop head, such as described in U.S. Pat. No. 6,305,046, incorporated herein by reference. Cleaning sheet 10 can be attached to mop head 80 by inserting end portions of the sheet into attachment structures 90 to mechanically attach the sheet to the mop head. After attachment of the sheet 10 to the mop, the top surface 44 of upper layer 40 is in contact with the bottom surface of the mop head.

The cleaning sheet may indicate how to attach the sheet to the mop by folding the sheet (prior to placing it in a package) such that the upper layer is folded in on top of itself with the lower layer side out. When a sheet is folded as described, the creases or folding lines are such that when the sheet is opened it becomes intuitive from the crease marks which part of the sheet contacts the mop head and which part faces the floor surface. To further identify the layers, the lower layer may be textured or have more of a three dimensional pattern on its bottom surface and the upper layer may be substantially flat and smooth on its top surface. Such texturing and three-dimensionality of the bottom surface of the sheet aids in large particle pick-up.

After the lower layer of sheet 10 is used to clean a floor, the lower and intermediate layers can be removed from the upper layer to expose the adhesive material on the bottom surface of the upper layer. In one embodiment, the consumer can peel off the lower and intermediate layers from the upper layer, for example, by pulling a tab or grip on the lower or intermediate layer. The upper layer can then be used to pick up remaining dirt and particulate material from the floor. For example, the mop can be lifted and the upper layer containing the adhesive applied, in a vertical up and down motion, against portions .of the floor containing dirt and particles. The upper layer can then be removed from the mop and discarded. A new cleaning sheet can be attached to the mop when the consumer is ready to again clean the floor. Thus, the invention also provides a method of cleaning a floor comprising: (1) providing a cleaning sheet being a laminate comprising a) a lower layer of a fibrous nonwoven web of hydrophobic polymer for contacting the floor, said lower layer having a bottom surface and a top surface, b) an intermediate layer having a bottom paper or plastic substrate attached to the top surface of the lower layer, and a top surface coated with a release material, and c) an upper layer releasably attached to the intermediate layer, said upper layer having a bottom surface comprising adhesive material on at least a central portion thereof and a top surface attachable to a bottom surface of a mop; (2) attaching the cleaning sheet to a mop; (3) cleaning a floor using the mop and attached cleaning sheet; (4) removing the lower and intermediate layers of the cleaning sheet from the upper layer to expose the adhesive material on the bottom surface of the upper layer; and (5) picking up remaining dirt and particles from the floor by applying the upper layer containing the adhesive against portions of the floor containing the dirt and particles.

While particular embodiments of the subject invention have been described, it will be apparent to those skilled in the art that various changes and modifications of the subject invention can be made without departing from the spirit and scope of the invention. In addition, while the present invention has been described in connection with certain specific embodiments thereof, it is to be understood that this is by way of limitation and the scope of the invention is defined by the appended claims which should be construed as broadly as the prior art will permit.

What is claimed is:

1. A cleaning sheet for attachment to a mop for cleaning a floor, said sheet being a laminate comprising: a) a lower layer of fibrous material for contacting the floor, said lower layer having a bottom surface and a top surface, b) an intermediate layer having a bottom surface attached to the top surface of the lower layer, and a top surface comprising release material, and c) an upper layer releasably attached to the intermediate layer, said upper layer having a bottom surface comprising adhesive material on at least a central portion thereof and a top surface attachable to a bottom surface of a mop, wherein after the lower layer is used to clean a floor, the lower and intermediate layers can be removed from the upper layer to expose the adhesive material on the bottom surface of the upper layer so it can be used to pick up remaining dirt and particulate material from the floor.

2. The cleaning sheet of claim 1 wherein the lower layer is a nonwoven web of hydrophobic polymer.

3. The cleaning sheet of claim 1 wherein the intermediate layer is a release layer comprising a paper or plastic substrate coated with a cross-linkable silicone release material.

4. The cleaning sheet of claim 1 wherein the intermediate layer is a wax paper.

5. The cleaning sheet of claim 1 wherein the intermediate layer is attached to the lower layer by glue or adhesive material or by thermal or mechanical bonding.

6. The cleaning sheet of claim 1 wherein the upper layer is a nonwoven web of hydrophobic polymer.

7. The cleaning sheet of claim 1 wherein the bottom surface of the upper layer has adhesive material coated on a middle portion thereof.

8. The cleaning sheet of claim 7 wherein the portion coated with adhesive has a width between about 40% and about 80% of the total width of the cleaning sheet.

9. The cleaning sheet of claim 8 wherein the adhesive is applied across at least about 75% of the length of the upper layer of the cleaning sheet.

10. The cleaning sheet of claim 9 wherein the lower layer and the upper layer are each a nonwoven web of hydrophobic polymer.

11. The cleaning sheet of claim 10 wherein the intermediate layer is a release layer comprising a paper or plastic substrate coated with a cross-linkable silicone release material.

12. A cleaning sheet for attachment to a mop for cleaning a floor, said sheet being a laminate comprising: a) a lower layer of a fibrous nonwoven web of hydrophobic polymer for contacting the floor, said lower layer having a bottom surface and a top surface, b) an intermediate layer having a bottom paper or plastic substrate attached to the top surface of the lower layer, and a top surface coated with a release material, and c) an upper layer releasably attached to the intermediate layer, said upper layer having a bottom surface comprising adhesive material on at least a central portion thereof and a top surface attachable to a bottom surface of a mop, wherein after the lower layer is used to clean a floor, the lower and intermediate layers can be removed from the upper layer to expose the adhesive material on the bottom surface of the upper layer so it can be used to pick up remaining dirt and particulate material from the floor.

13. The cleaning sheet of claim 12 wherein the intermediate layer comprises a paper or plastic substrate coated with a cross-linkable silicone release material.

14. The cleaning sheet of claim 13 wherein the central portion of the upper layer coated with adhesive has a width between about 40% and about 80% of the total width of the cleaning sheet.

15. The cleaning sheet of claim 14 wherein the adhesive is applied across at least about 75% of the length of the upper layer of the cleaning sheet.

16. A method of cleaning a floor comprising: (1) providing a cleaning sheet being a laminate comprising a) a lower layer of a fibrous nonwoven web of hydrophobic polymer for contacting the floor, said lower layer having a bottom surface and a top surface, b) an intermediate layer having a bottom paper or plastic substrate attached to the top surface of the lower layer, and a top surface coated with a release material, and c) an upper layer releasably attached to the intermediate layer, said upper layer having a bottom surface comprising adhesive material on at least a central portion thereof and a top surface attachable to a bottom surface of a mop; (2) attaching the cleaning sheet to a mop; (3) cleaning a floor using the mop and attached cleaning sheet; (4) removing the lower and intermediate layers of the cleaning sheet from the upper layer to expose the adhesive material on the bottom surface of the upper layer; and (5) picking up remaining dirt and particles from the floor by applying the upper layer containing the adhesive against portions of the floor containing the dirt and particles.

17. The method of claim 16 wherein the intermediate layer of the cleaning sheet is a release layer comprising a paper or plastic substrate coated with a cross-linkable silicone release material.

18. The method of claim 17 wherein the central portion of the upper layer of the cleaning sheet coated with adhesive has a width between about 40% and about 80% of the total width of the cleaning sheet.

19. The method of claim 18 wherein the adhesive is applied across at least about 75% of the length of the upper layer of the cleaning sheet.

* * * * *